United States Patent [19]

Fukunaga et al.

[11] 4,023,876

[45] May 17, 1977

[54] METHOD OF MAKING A FLUORESCENT DISPLAY DEVICE HAVING SEGMENTARY ANODES

[75] Inventors: Ichiro Fukunaga; Akira Kani, both of Nagoya; Shuji Sakanishi, Odawara, all of Japan

[73] Assignee: Nippon Toki Kabushiki Kaisha, Nagoya, Japan

[22] Filed: May 19, 1975

[21] Appl. No.: 578,967

[30] Foreign Application Priority Data

May 23, 1974 Japan ..... 49-57349

[52] U.S. Cl. ..... 316/19; 313/217; 313/220; 313/497

[51] Int. Cl.² ..... H01J 9/18; H01J 9/26; H01J 63/02; H01J 63/06

[58] Field of Search ..... 313/496, 497, 220, 217; 316/17, 19, 20

[56] References Cited

UNITED STATES PATENTS

| | | | |
|---|---|---|---|
| 3,532,921 | 10/1970 | Akabane et al. | 313/497 |
| 3,668,466 | 6/1972 | Shimada et al. | 313/497 X |
| 3,787,940 | 1/1974 | Kupsky | 316/17 X |
| 3,800,178 | 3/1974 | Farina | 313/220 X |
| 3,864,593 | 2/1975 | Kasano | 313/514 |
| 3,873,169 | 3/1975 | Miyamoto et al. | 316/20 |

*Primary Examiner*—Palmer C. Demeo
*Attorney, Agent, or Firm*—Frank J. Jordan

[57] ABSTRACT

A fluorescent display device comprising a glass base plate fitted thereon with, as the main components, fluorescent material-coated segmentary electrodes, controlling grid electrodes and a cathode for emitting thermal electrons, and a glass panel fusion bonded to said glass base plate so as to cover said electrodes, the fusion bond being effected at much lower temperatures than before.

4 Claims, 5 Drawing Figures

Fig. 1
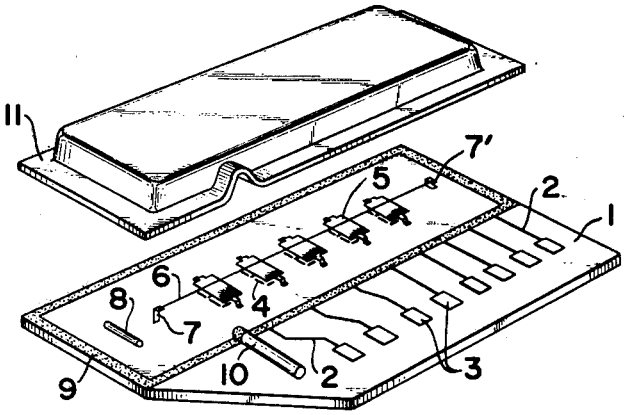
Fig. 2
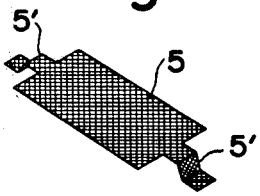
Fig. 3
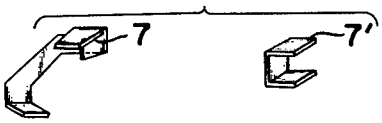
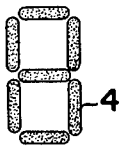
Fig. 4A
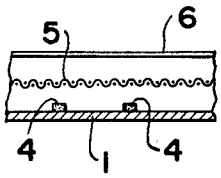
Fig. 4B

METHOD OF MAKING A FLUORESCENT DISPLAY DEVICE HAVING SEGMENTARY ANODES

This invention relates to a fluorescent display device and more particularly it relates to a multi-figure fluorescent display device comprising a hermetically sealed vacuum envelope wherein the edge of a glass panel or cover has been fusion bonded, at a relatively low temperature and in a simplified manner, to the corresponding edge of a glass base plate on which component members necessary for fluorescent display are fixed, the device being inexpensive, highly reliable in quality and simple in construction.

There have heretofore been used so-called ceramic base plates which are made by sintering alumina or the like, as insulating base plates on which are fixed fluorescent material-coated anodes, controlling electrodes and the supports for a filamentary cathode. In conventional fluorescent display devices, the supports for fixing each of wire mesh type controlling electrodes to the insulating base plate require partial cutting or perforation of the base plate through which a portion of the support is passed to the reverse side of the base plate where said portion is secured thereto thereby fixing the whole of the support to the base plate and, thus, it is necessary to use the ceramic base plate which is difficult to cause its cracks or crazes when subjected to machining such as said cutting or perforation. Since the conventional display devices are of such structure as above, it is customary to place the insulating base plate, to which are fitted the fluorescent material-coated anodes, controlling electrodes, filamentary cathode and the like, in a glass tube having a circular or elliptic shape in cross section and hermetically seal the glass tube with lead wires sealably extending outwards through the wall thereof at each end. Furthermore, if the glass panel is attempted to be fusion bonded to the ceramic insulating base plate, it will be difficult to select a suitable glass paste binder for fusion bond since the ceramic base plate and the glass panel are different in thermal expansion coefficient from each other and it will be necessary to employ relatively high temperature since the glass paste binder for fusion bond is required to be lowered in melt viscosity so as to compensate the roughness of surface of the ceramic base plate or effect a satisfactory fusion bond between the base plate and glass panel despite the roughness of the surface of the base plate. If the fusion bond is effected at such high temperatures, then the generally used controlling grids and the filamentary cathode supports, which are each made of stainless steel, will be oxidized. Thus, in order to avoid such oxidation, the fusion bond is necessary to effect in an atmosphere of an inert gas or under vacuum. The conventional fluorescent display devices have further disadvantages that the firing furnaces for use in the manufacture of the devices are structurally limited, the material for the anodes must be a selected one which does not contaminate the fluorescent material therewith by its thermal diffusion, the spring portion provided at each support for the filamentary electrode must be one which is specifically selected with respect to quality, and other various limitations exist. In order to obtain fluorescent display devices which eliminate all of the aforementioned disadvantages, there have been incurred greater expenses including the cost of equipment for making the devices, the cost of operation of the equipment, the expense of starting materials for the devices, the cost of production thereof and the like. As mentioned above the construction of multi-figure fluorescent display devices and the technique of manufacturing the same are not satisfactorily accomplished as yet. There have thus been sought highly reliable compact multi-figure fluorescent display devices and simplified processes for manufacturing the same.

It is an object of this invention, therefore, to provide a novel form of fluorescent display device wherein the glass panel is fusion bonded at relatively low temperatures to the glass base plate with necessary component elements fixed thereon.

Another object of this invention is to provide a novel process for manufacturing such fluorescent display devices.

In accordance with this invention, a fluorescent display device is obtained by applying a glass fusion bonding paste to the edge portion of a glass base plate on which are fixed fluorescent material-coated anodes, controlling electrodes, a filamentary cathode for emitting thermal electrons and other necessary components, and/or to the edge portion of a glass panel which will be bonded just to said edge portion of the glass base plate, preliminarily firing the glass base plate and glass panel while keeping them separated from each other in an oxidizing atmosphere, closely putting them together while keeping their edge portions to be bonded just faced to each other, applying a suitable load to the glass base plate and glass panel to ensure close contact therebetween if desired, and then completely firing the plate and panel thereby obtaining the fluorescent display device.

Further objects and advantages of this invention will be apparent from the following detailed description and from the accompanying drawings, in which:

FIG. 1 is an exploded perspective view of an embodiment of fluorescent display device of this invention, FIG. 2 is a perspective view of a controlling grid electrode used in the display device of FIG. 1, FIG. 3 is a perspective view of supports to which are respectively fixed the ends of a thermal electron-emitting filamentary electrode used in the display device of FIG. 1, FIG. 4A is an enlarged view of the segments of an anode used in the display device of FIG. 1 and FIG. 4B is a diagrammatic view showing the positions of the main component elements with respect to each other in the display device of FIG. 1.

This invention will be illustrated by reference to the following example in conjunction with the drawings.

Referring now particularly to FIG. 1, a flat glass base plate 1 is provided. Lead wires 2 and connecting terminals 3 are printed with a conductor paste on the glass base plate 1 by the use of a screen printing technique and the whole mass is heated to 550° – 600° C to fire the printed lead wires and connecting terminals. Thereafter an insulating glass paste is coated by the screen printing technique on the surface portion of the glass base plate 1 other than the surface portions thereof on which are fixed or provided not only anode segments 4, controlling grid electrodes 5 and the supports 7 and 7′ of a thermal electron-emitting filamentary cathode 6, but also the holes (not shown) through which lead wires (or conductors) are passed and the connecting terminals 3. The glass base plate so coated is then fired at 540° – 590° C. Segmentary electrodes 4 are formed by printing a conductor paste for the anode so that it takes the form of these electrodes on the glass base plate by the use of the screen printing technique and then firing the printed paste at 530° – 580° C. Thus, the conductor paste is preferably such that the conductor material in the paste melts at 530° – 600° C. The segmentary electrodes so printed and fired are coated with fluorescent material by a sedimentation, dusting, screen printing or electrostatic printing method, or the like, thereby obtaining the finished or indicating electrodes 4. After so coated, the coated electrodes are heated to remove the solvent, resin or the like therefrom if necessary. The controlling grid electrodes 5 are in the form of a metal wire or wire mesh and have narrow end portions, and these end portions are connected and secured to the corresponding lead wires by the use of the conductor paste, respectively. At the same time as this, the supports 7 and 7' for the filamentary cathode 6 as shown in FIG. 3 are connected and secured to lead wires 2 with the conductor paste. A getter 8 is also secured to the glass base plate 1 with the conductor paste. Then, the fusion bonding glass paste 9 is coated on the glass base plate edge portion to which the edge portion of the glass panel 1 is to be fusion bonded, and an evacuation tube 10 is also coated with the glass paste 9 at one end portion which will be sealably fixed between the edge portions of the base plate 1 and glass panel 11 as seen from FIG. 1. The glass panel 11 is prepared by, for example, pressing a rectangular plate glass of the same material as that of the glass base plate 1 into such a shape as indicated at 11 in FIG. 1. The evacuation tube 10 is made of a glass having substantially the same thermal expansion coefficient as the glass base plate 1. The glass panel 11 is then coated with the fusion bonding glass paste 9 at the edge portion thereof to be bonded to that of the glass base plate 1. The glass-paste coated glass base plate 1, glass panel 11 and evacuation tube 10 are dried while keeping them separated from each other, thereby to make easily burnable the resin contained in the glass paste 9. The three so dried are placed in a furnace where they are preliminarily fired in an oxidizing atmosphere at a temperature below that at which the fusion bond is effected, thereby to entirely remove from the coated glass paste the resin and solvent contained therein. The glass base plate 1, evacuation tube 10 and glass panel 11 so preliminarily fired, are put together in position to form an assembled mass which, after applying some load to it if desired, is then heated to the fusion bonding temperature thereby obtaining a finally fired mass, that is a fusion bonded mass. The fusion bonded mass is subjected to evacuation, hermetical sealing, gettering and aging in the same manner as in the conventional fluorescent display tubes, whereby a fluorescent display device of this invention is obtained.

The fusion bonding glass pastes which may be used in this invention, are those in which the glass melts at a fusion bonding temperature of 350° – 580° C. If a glass paste in which the glass melts at a fusion bonding temperature of lower than 350° C is used as the paste in this invention, it will partially melt before complete combustion of the resin and solvent contained in the glass paste during preliminary firing by which said resin and solvent are attempted to be removed, thus leaving carbon in the glass paste. On the other hand, the use of a glass paste in which the glass melts at a fusion temperature of higher than 580° C will result in the remarkable oxidation and qualitative deterioration of various metallic materials used in a display device to be manufactured by the use of said glass paste, thereby making it difficult to obtain a high vacuum in the resulting display device and exerting an adverse effect on the life thereof. In order to avoid these drawbacks, the various materials used in the manufacture of the display device must be selected ones adapted for the purpose intended and they must be fusion bonded to one another as required in the atmosphere of an inert gas or in vacuo in the manufacture of the device. In view of the thermal effect on the conductor used for bonding the controlling grid electrodes and filamentary cathode supports to the glass base plate as well as of the prevention of the anode material from diffusing into the fluorescent material, a fusion bonding glass paste in which the glass melts at a fusion bonding temperature of 400° – 500° C is the best as the paste. In addition, the glass component of the best glass paste must be one which has approximately the same thermal expansion coefficient as the glass base plate and glass panel and will usually not cause any damages such as cracking and peeling in the resulting display device at the time of fusion bonding due to the difference in thermal expansion coefficient between the bonding glass and other components of the device. The resins preferably used in the fusion bonding glass paste are those which can be burnt out at low temperatures leaving substantially no carbon. Nitrocellulose is typical of such a preferable resin. It is desirable that the amount of resin used should be limited to a minimum.

The conductor pastes used herein comprise as the conductor material at least one of Au, Ag, Pt, Pd, Rh and the like in finely divided form, as the refractory binder a low melting glass powder and as the combustible binder at least one organic resin such as an alkyd resin or ethylcellulose. An example of composition of the conductor pastes is as follows.

| | |
|---|---|
| Powdered silver (average particle size: 0.5 $\mu$) | 60 wt.% |
| Lead borosilicate glass in powder form (average particle size: 2 $\mu$; softening point: 550° C) | 5.0 |
| Ethyl cellulose | 3.5 |
| Alkyd resin | 12.5 |
| Turpentine oil | 7.0 |
| Ethylene glycol monoethyl ether | 12.0 |
| Firing temp. 500 – 600° C | |
| Area resistance <0.005 Ω/□ | |

A preferable example of the glass material contained in the fusion bonding glass paste used herein is a PbO - ZnO - $B_2O_3$ type glass melting at a fusion bonding temperature of about 430° to about 520° C and having the following composition:

as the essential ingredients,

PbO 60 – 80 wt.%
ZnO 5 – 19 wt.%
$B_2O_3$ 10 – 20 wt.% and as the optional ingredients, $SiO_2$
$Al_2O_3$
BaO
etc.

in a total amount of several wt.% (for example, 3 to 8 wt.%).

If, soon after being coated with the fusion bonding glass paste, the coated glass base plate, evacuation tube and glass panel are put together in position, dried and heated to the fusion bonding temperature to effect the fusion bond between the three, the fusion bonded glass will allow some of produced carbon and some of produced bubbles to remain therein thereby impairing the airtightness of the fusion bonded portions very often and contaminating the fluorescent material with the result of a remarkable increase in luminescence voltage of the fluorescent material. For example, the previously mentioned fluorescent display device embodying this invention can obtain sufficient luminance to effect satisfactorily clear display at an applied voltage of 20 – 30 volts; while the aforesaid fluorescent display device prepared by putting the necessary components together before drying and preliminary firing, requires a voltage of 80 – 150 volts to obtain the same luminance as the above device of this invention. These disadvantages result due to lack of oxygen in the resulting display device at the time of fusion bonding and they can be eliminated by the supply of oxygen into the resulting device at said time. However, this eliminating method does not permit easy establishment of plant equipment for carrying out the method in a mass-production scale, is liable to produce rejects or rejected products contaminated with scattered fluorescent material or the like and is not adapted for the mass production of satisfactory display devices.

In contrast, according to the process of the Example of this invention, the preliminary fusion bonding and the final one may both be effected in a continuous furnace wherein both the fusion bondings are successively conducted without leaving the bubbles and carbon in the fusion bonded glass portion and creating substantially poor airtightness, thereby ensuring the production of display devices having high luminance or brightness. In addition, the usual fluorescent display devices include the filamentary cathode coated with an oxide containing a resin; on the other hand, according to the present invention, the entire removal, at the time of preliminary firing, of such resin portion applied to the filamentary cathode together with such an oxide will also have a favorable effect on the luminance of the resulting display device.

For comparison, the procedure of the aforesaid Example was followed except that glass base plate 1 was substituted by a sintered holstelite base plate having a thermal expansion coefficient similar to that of the glass panel 11 thereby to manufacture a display device. The thus-manufactured display device had no crack and peeling-off at its fusion bonded portions; however, it was unsatisfactorily airtight at many portions thereof. The reason for this unsatisfactory airtightness was investigated and, as a result of this investigation, it was found that the holstelite base plate had, at its fusion bonded portions, gaps caused by local poor sintering and deep grooves formed presumably at the time of grinding, and that these gaps and grooves were not entirely filled with the fusion bonding glass thereby effecting an imperfect fusion bond. In order to avoid such unsatisfactory airtightness, it is necessary to use a base plate which has been freed from pores, sintered and polished to be more flattened than the heretofore commercially available one; such a base plate is therefore very expensive. The aforesaid rough surface condition is common to ceramic sintered base plates, and a remedy for such a drawback or a method of eliminating the drawback is applicable to any ceramic base plates. The glass base plates according to this invention are thus superior to the ceramic base plates from the viewpoint of quality and cost. In this Example, the evacuation tube 10 is fixed between the base plate 1 and panel 11 in parallel with the surface of the plate 1 as shown in FIG. 1, or else it may be fixed on another edge of the base plate 1 or on the reverse side thereof as far as it can be used for the purpose of evacuation of gas. The glass base plate is indicated in the form of pentagon in this Example; however, it may be rectangular in shape. The glass panel is required to be one which is shaped in conformity to the shape of the glass base plate and the position thereon at which the evacuation tube is to be fixed. If the evacuation tube is to be fixed on the reverse side of the base plate, the base plate is previously perforated by the use of a drill or diamond grinder so as to obtain a hole having a diameter of, for example, 2 – 5 mm and, thereafter, the glass panel and the evacuation tube inserted in said hole are simultaneously fusion bonded to the base plate by using suitable jigs.

As compared with the conventional display devices prepared by fixing the fluorescent material-coated anodes, controlling electrodes and thermal electron-emitting filamentary electrode on the ceramic base plate, welding the lead wires for the anodes and electrodes thereon, inserting the whole mass in the glass tube and then suitably treated, the display devices of this invention are approximately plate-like in shape and small in volume thereby rendering it easy and convenient to use them particularly in small-sized computers and they are further advantageous in that they can be manufactured as multi-figure fluorescent display devices in a mass-production scale from the less expensive starting materials by the use of the much more simplified process.

As is apparent from the above, the glass base plates according to this invention are superior in airtightness in fusion bonded portions to the ceramic base plates when fusion bonded. Further, since the firing temperatures used after the coating of fluorescent material on the anodes in this invention are lower than usual, even the use of a low-temperature firing conductor paste such as a silver-palladium type one, in the formation of the display anodes will have hardly any adverse effect on the luminance or brightness of the fluorescent material. According to this invention, therefore, there is not needed a conventionally-used complicated step wherein a metallized layer is provided and a nickel plate is formed on the metallized layer.

What is claimed is:

1. A process for the preparation of a fluorescent display device of the type which is fitted with segmentary anodes, controlling grid electrodes, and supports for a thermal electron emitting filamentary cathode, comprising the steps of providing a flat glass base plate member, printing a conductor paste for lead wires and connecting terminals on the glass base plate member, firing the thus-printed paste at from 550° to 600° C to obtain the lead wires and connecting terminals, coating an insulating glass paste on the surface of a portion of the glass base plate member other than that portion on which will be subsequently fitted said segmentary anodes, said controlling grid electrodes, and said supports for the thermal electron-emitting filamentary cathode, firing the thus-coated glass paste at from 540° to 590° C to obtain an insulating layer on the glass base plate member, printing a conductor paste for said segmentary anodes on the glass base plate member, firing the thus-printed paste at from 530° to 580° C to obtain the segmentary anodes, coating said latter segmentary anodes with fluorescent material, fitting said controlling grid electrodes and said supports for the filamentary cathode respectively to said lead wires, fusion bonding a glass panel member to said glass base plate member to cover said segmentary anodes, said controlling grid electrodes and said cathode, said fusion bonding step comprising coating a fusion bonding glass paste comprising a resin and a solvent on at least one of said members along the portions to be fusion bonded together, drying said at least one paste-coated member, preliminarily firing said paste-coated member while keeping the latter separated from said other member to entirely remove from said paste-coated member the resin and solvent contained in said paste, and finally firing said two members in mated position at from 350° to 580° C to form an assembled mass which is subsequently subjected to evacuation, hermetical sealing, gettering and aging to thereby obtain said fluorescent display device.

2. A process according to claim 1 further comprising the step of sealing an evacuation tube between said two members by coating said fusion bonding glass paste to at lease one end portion of said tube, drying said paste-coated tube, preliminary firing said paste-coated tube while keeping the latter separated from said other paste-coated member to entirely remove the resin and solvent contained in said paste, and mating said sealing tube in position engaged between said two members, such that said final firing is effected with said tube in said mated position, whereby said tube is sealed to said assembled mass to provide for evacuation of the latter.

3. A process according to claim 1 wherein said preliminary firing is effected in an oxidizing atmosphere at a temperature below that at which the fusion bond is effected.

4. A process according to claim 1 wherein said glass base plate member is provided with holes through which lead wires are passed to said connecting terminals.

* * * * *